US009837773B2

(12) United States Patent
Sumskas et al.

(10) Patent No.: US 9,837,773 B2
(45) Date of Patent: Dec. 5, 2017

(54) ELECTRICAL CONNECTOR

(71) Applicants: Eugenijus Sumskas, Wixom, MI (US); Henry Hengzhi Yang, Livonia, MI (US)

(72) Inventors: Eugenijus Sumskas, Wixom, MI (US); Henry Hengzhi Yang, Livonia, MI (US)

(73) Assignee: Danlaw, Inc., Novi, MI (US)

( * ) Notice: Subject to any disclaimer, the term of this patent is extended or adjusted under 35 U.S.C. 154(b) by 0 days.

(21) Appl. No.: 15/088,484

(22) Filed: Apr. 1, 2016

(65) Prior Publication Data

US 2017/0288353 A1 Oct. 5, 2017

(51) Int. Cl.

| | |
|---|---|
| ***H01R 24/68*** | (2011.01) |
| ***H01R 13/502*** | (2006.01) |
| ***H01R 12/71*** | (2011.01) |
| ***H01R 43/02*** | (2006.01) |

(52) U.S. Cl.

CPC ..... *H01R 24/68* (2013.01); *H01R 12/716* (2013.01); *H01R 13/502* (2013.01); *H01R 43/0256* (2013.01)

(58) Field of Classification Search

CPC .... H01R 24/68; H01R 13/502; H01R 13/518; H01R 43/16; H01R 43/0256; H01R 12/716

USPC ..... 439/83, 787, 439, 884, 885

See application file for complete search history.

(56) References Cited

U.S. PATENT DOCUMENTS

| | | | | |
|---|---|---|---|---|
| 5,322,445 | A * | 6/1994 | Ozaki | B60R 16/02 439/212 |
| 5,415,568 | A * | 5/1995 | Kinoshita | H01R 43/16 439/607.5 |
| 5,490,794 | A * | 2/1996 | Kobayashi | H01R 9/226 439/212 |
| 7,568,917 | B1 * | 8/2009 | Malstrom | H01R 31/085 439/66 |
| 7,611,387 | B1 * | 11/2009 | Zhang | H01R 23/6873 439/660 |
| 7,833,065 | B2 * | 11/2010 | Lin | H01R 13/65802 439/638 |
| 7,914,346 | B2 * | 3/2011 | Pharney | H01R 13/6658 439/676 |
| 8,465,299 | B2 * | 6/2013 | Ho | H01R 13/506 439/607.05 |

* cited by examiner

*Primary Examiner* — Harshad Patel
(74) *Attorney, Agent, or Firm* — Brinks Gilson & Lione

(57) ABSTRACT

An electrical connector includes a plurality of connector units each having a base, a first pin, a second pin, and a soldering pad. The connector units may be linked together to form an array of connector units by a plurality of bridges that connect the bases of successive connector units. The bases of the connector units may be embedded in a plastic carrier material. The bridges and the portions of the bases to which the bridges connect may be positioned in the carrier unit such that they may be cut away from the rest of the electrical connector. The soldering pads and soldering ports of the first pins are configured to be soldered to a printed circuit board, resulting in two rows of electrically independent pins soldered to a single printed circuit board. A housing may be used to isolate the circuit board from forces applied to the pins.

16 Claims, 6 Drawing Sheets

ELECTRICAL CONNECTOR

FIELD

The present disclosure relates to an electrical connector and a method for assembling an electrical connector assembly.

BACKGROUND

The statements in this section merely provide background information related to the present disclosure and may not constitute prior art.

For many years, motor vehicles have included an on board computer system. As these systems have developed and their capabilities have increased, devices have been developed to communicate with and receive information from a vehicle's computer system, including diagnostic information, driver habit information, and drive parameter information. These devices are commonly small pieces of hardware that may be connected to a motor vehicle to provide additional functionality to the vehicle's computer system or receive information. These devices may be connected to a vehicle via the vehicle's On-Board Diagnostic port or a similar connection port. These devices typically include a circuit board for transferring information and signals between circuit components and external devices, pins for electrically connecting the circuit board to an external device, and a housing to protect the circuit board.

Despite the satisfactory performance of conventional electrical connectors and component configurations for such devices, there is constantly a desire to reduced cost and increase ease of assembly, while providing a desirable durability, low warranty claim, and compliance with performance requirements.

SUMMARY

The present disclosure provides an electrical connector and a method for assembling an electrical connector assembly capable of reducing the cost and increasing the ease of assembly while maintaining the durability and functionality of the device.

According to one form of the present disclosure, an electrical connector includes a plurality of connector units each having a base formed of a first arm and a second arm. The first arm and second arm of each connector unit may be joined together by a cross member. For each connector unit, a first pin is integrally formed with and extends from a first end of the first arm. The first pin of each connector unit has a soldering portion and a blade portion. Additionally, a second pin is integrally formed with and extends from a second end of the first arm of each connector unit. Each connector unit also has a soldering pad integrally formed with and extending from a first end of the second arm. The soldering portion and the soldering pad of each connector unit are configured to be soldered to a printed circuit board to attach the electrical connector to the printed circuit board. Additionally, a bridge is integrally formed with and extends between the first arm of one connector unit and the second arm of another connector unit, thereby linking the plurality of connector units together to form an array of connector units. Each bridge and a portion of the first arm of each connector unit are configured to be cut out such that two rows of electrically independent pins are arranged on the printed circuit board.

According to one aspect of the present disclosure, the electrical connector may further include a fixturing tab integrally formed with and extending from the base of the first connector unit in the array of connector units. A second fixturing tab may also be integrally formed with and extend from the base of the last connector unit in the array of connector units. The fixturing tabs may be used to locate the electrical connector relative to the printed circuit board when positioning the electrical connector on the printed circuit board for soldering.

According to another aspect of the present disclosure the electrical connector may include a plastic carrier. In such an embodiment, the base of each connector unit is embedded in a plastic material that forms the plastic carrier. The plastic carrier embeds the base of each connector unit such that a first surface of each connector unit base remains uncovered by the plastic material of the plastic carrier. In other words, the surface of the connector unit that is opposite the pins remains exposed and uncovered by the plastic carrier. The plastic carrier may further embed the soldering portion and the soldering tab of each connector unit while leaving a soldering surface of each soldering portion and soldering pad exposed. According to yet another aspect of the present disclosure, the plastic carrier may include a fixturing tab to assist with locating the electrical connector relative to the printed circuit board. According to another form of the present disclosure, the plastic carrier may define a plurality of apertures that extend through a thickness of the plastic carrier. Each aperture may be positioned such that the bridge and the portion of the first arm of each connector unit that are configured to be cut out are not embedded in the plastic carrier.

Another aspect of the present disclosure includes the electrical connector installed in a housing. The housing may include a wall that defines a plurality of apertures through which the pins of the electrical connector may be inserted. The housing may further include a first shell piece and a second shell piece. The second shell piece may include a shelf that protrudes from the second shell piece. The first shell piece and second shell piece may be joined together and joined with the wall. Joined together, the wall, first shell piece, and second shell piece define a cavity into which the shelf protrudes. The cavity may further house the printed circuit board. The shelf may abut the first surface of the base of each connector unit to lock the electrical connector against the wall.

According to another form of the present disclosure, an electrical connector assembly includes a single printed circuit board, a first row of electrically independent pins, and a second row of electrically independent pins. Each pin of the first row of pins has a soldering portion and a blade portion. Each soldering portion may be soldered to the printed circuit board. Additionally, each pin of the second row of pins has a soldering pad, a blade portion, and an arm portion. The arm portion of each pin of the second row of pins is integrally formed with both the soldering pad and blade portion of each second row pin to connect the soldering pad and blade portion of each of the second row pins. Additionally, each soldering pad may be soldered to the printed circuit board.

According to yet another form of the present disclosure, a method for manufacturing an electrical connector assembly includes providing an electrical connector as described above. The method further includes embedding the base of each of the connector units in a plastic carrier such that a first surface of each connector unit base remains uncovered by the plastic carrier. As described above, the plastic carrier may define a plurality of apertures that extend through a thickness of the plastic carrier. Each aperture is positioned such that the bridge and a portion of the first arm of each connector unit are not embedded in the plastic carrier. The method further includes shearing off the bridge and the portion of the first arm of each connector unit that are not embedded in the plastic carrier. The method continues by positioning the electrical connector embedded in the plastic carrier on a printed circuit board such that the soldering portion of each connector unit and the soldering pad of each connector unit are in contact with the printed circuit board to form a pre-soldering assembly. Next, the method includes passing the pre-soldering assembly through a reflow oven to solder the soldering portions and soldering pads to the printed circuit board.

Further aspects of the disclosure are explained in greater detail below by means of preferred illustrative embodiment with reference to the attached drawings. The drawings are provided for purely illustrative purposes and are not intended to limit the scope of the present disclosure.

BRIEF DESCRIPTION OF THE DRAWINGS

Further details of the disclosure are described in more detail with reference to the drawings, in which.

DETAILED DESCRIPTION

Figure 1:
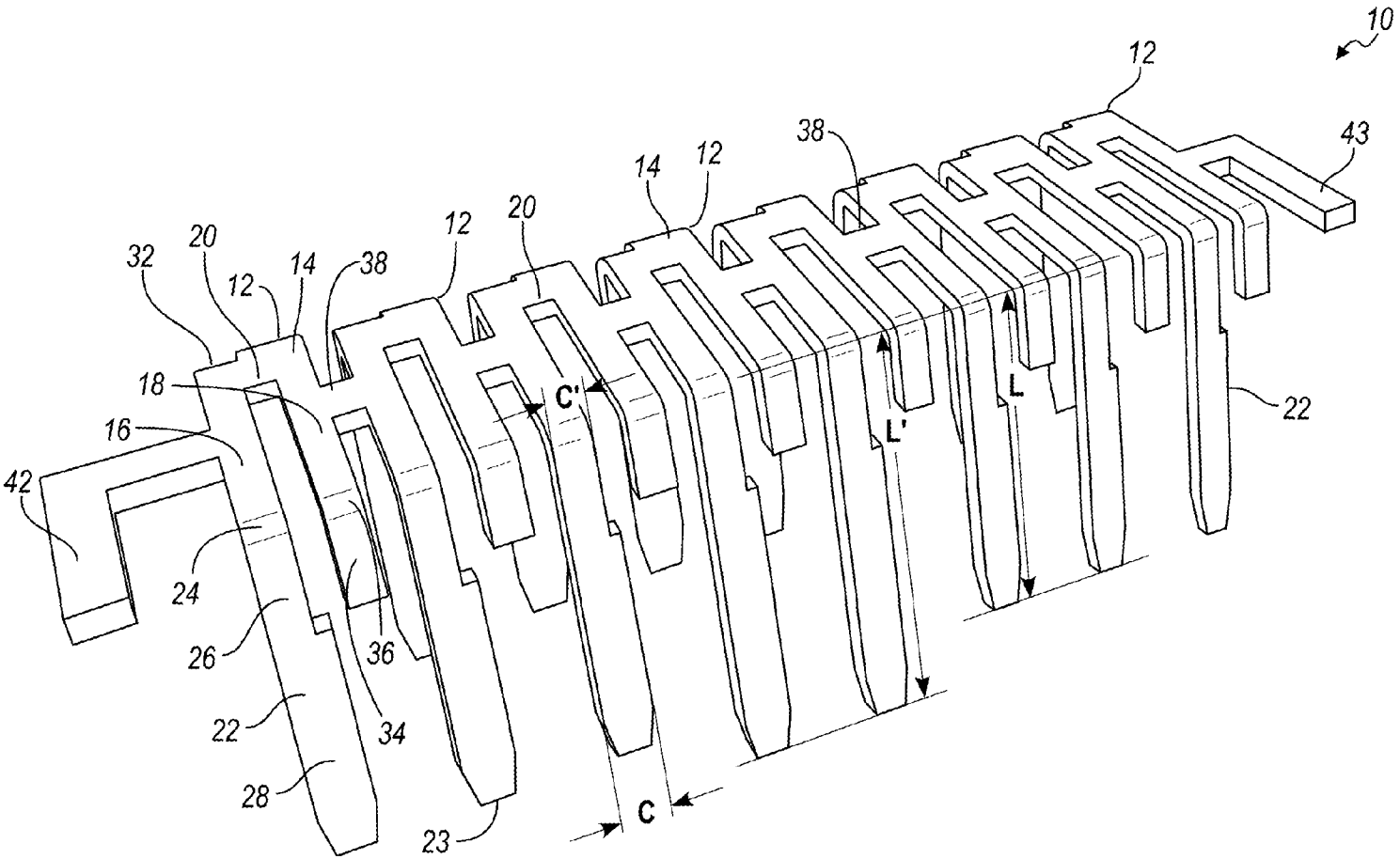
FIG. 1 is a perspective view of an electrical connector in accordance with a form of the present disclosure.

The following description is merely exemplary in nature and is not intended to limit the present disclosure, application, or uses. It should be understood that throughout the drawings, corresponding reference numerals indicate like or corresponding parts and features.

The present disclosure provides an electrical connector and a method for assembling an electrical connector assembly.

Figure 2:
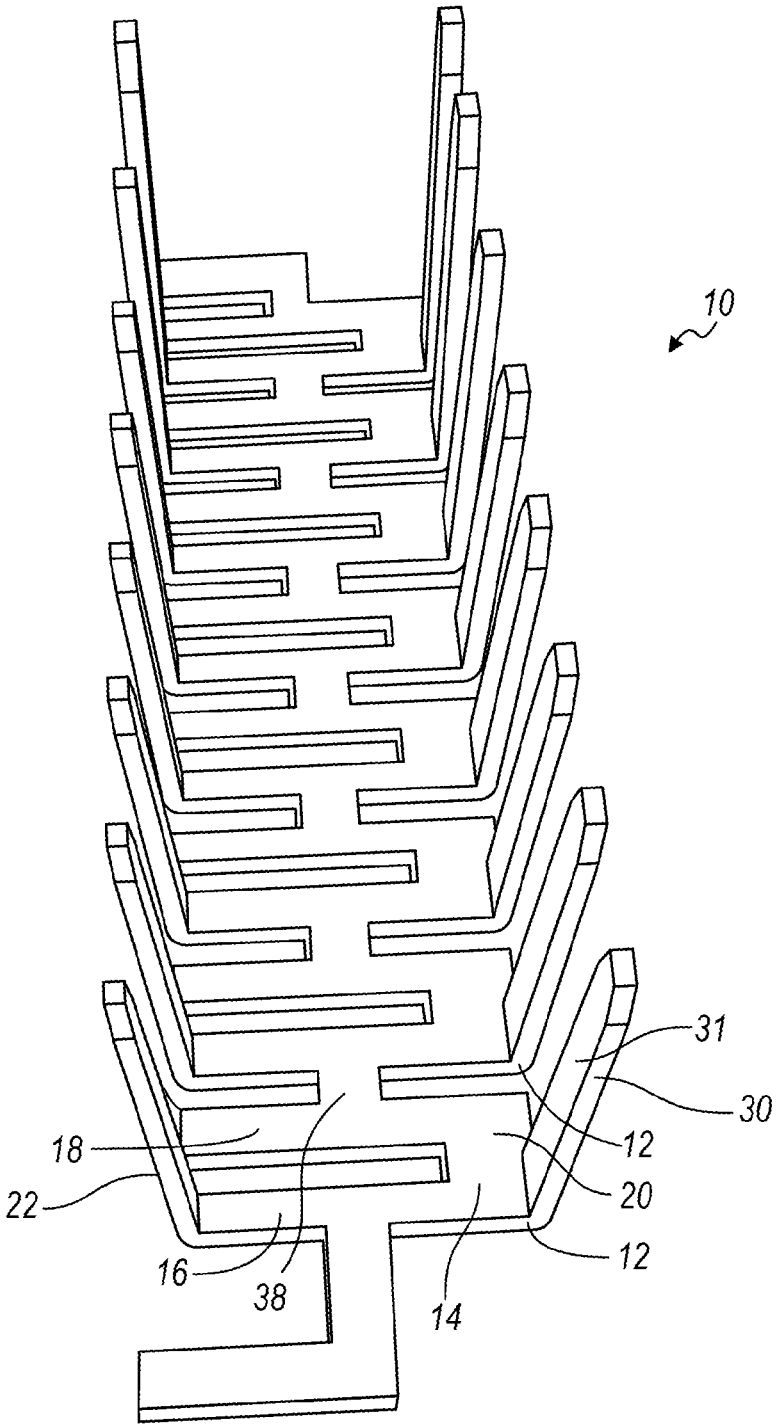
FIG. 2 is an alternate perspective view of the electrical connector of FIG. 1.

Referring first to FIGS. 1 and 2, an electrical connector 10 includes a plurality of connector units 12 each having a base 14 formed of a first arm 16 and a second arm 18. Each base 14 may be substantially U-shaped. The first arm 16 and second arm 18 of each connector unit 12 may be joined together by a cross member 20. For each connector unit 12, a first pin 22 is integrally formed with and extends from a first end 24 of the first arm 16. The first pin 22 may be substantially perpendicular to the first arm 16 from which it extends. The first pin 22 of each connector unit 12 has a soldering portion 26 and a blade portion 28. The blade portion 28 of each of the first pins 22 is configured to make contact and thereby electrically connect with a connector or port of an external device or cable. The soldering portion 26 of each of the first pins 22 is configured to be soldered to a printed circuit board 40. Each connector unit 12 also includes a second pin 30 that is integrally formed with and extends from a second end 32 of the first arm 16 of each connector unit 12. The second pin 30 may be substantially perpendicular to the first arm 16 from which it extends. Each connector unit 12 also has a soldering pad 34 integrally formed with and extending from a first end 36 of the second arm 18. The soldering pad 34 may be substantially perpendicular to the second arm 18 from which it extends. Individual connector units 12 of the electrical connector 10 may be linked together by a bridge 38 such that a bridge 38 links two connector units 12 together. Each bridge 38 may be integrally formed with and extend between the first arm 16 of one connector unit 12 and the second arm 18 of another connector unit 12. Accordingly, bridges 38 may link all successive connector units 12 of the plurality of connector units, thereby linking the plurality of connector units 12 together to form an array or chain of connector units. Accordingly, the electrical connector 10 may be a single unitary piece formed of an electrically conductive material, such as brass.

Each bridge 38 and a portion of the first arm 16 of each connector unit 12 are configured to be cut out. Specifically, each bridge 38 and the portion of the first arm 16 to which each bridge 38 connects may be cut, sheared, or punched out to remove the material making up the bridge 38 and each respective portion of the first arms 16. Removing such material from the electrical connector 10 creates two rows of electrically independent pins are arranged on the printed circuit board 40. The first row of pins including the first pins 22 of each of the connector units 12 and the second row of pins including the second pins 30 of each of the connector units 12.

The pins 22, 30 of the electrical connector 10 may be of unequal lengths such that some pins 22, 30 have a length of L while other pins 22, 30 have a length of L'. The pins 22, 30 may have a constant cross-sectional area C along the entire length L, L' of the pin 22, 30. Alternatively, the first pins 22 may have a non-constant cross-sectional area. For example, the blade portions 28 of the first pins 22 may have a first cross-sectional area C, while the soldering portions 26 of the first pins 22 may have a second cross-sectional area C'. The cross-sectional area C' of the soldering portions 26 of the first pins 22 may be substantially equal to a cross-sectional area C' of the soldering pads 34. Additionally, the pins 22, 30 may end in a tapered point 23.

The electrical connector 10 may be thought of as a surface mount electronic component for use with a circuit board. To mount or attach the electrical connector 10 a printed circuit board 40, the soldering portion 26 and the soldering pad 34 of each connector unit 12 are configured to be soldered to a printed circuit board 40. The soldering portions 26 and the soldering pad 34 of the electrical connector 10 may be soldered to the printed circuit board 40 using a surface mount technology soldering machine or a reflow oven.

According to one aspect of the present disclosure, the electrical connector 10 may further include a first fixturing tab 42. The first fixturing tab 42 may be further integrally formed with and extend from the base 14 of the first connector unit in the array of connector units 12. A second fixturing tab 43 may also be integrally formed with and extend from the base 14 of the last connector unit in the array of connector units 12. In other words, the fixturing tabs 42, 43 may be placed at the outside ends of the electrical connector 10. The fixturing tabs 42, 43 may be used to locate the electrical connector 10 relative to the printed circuit board 40 when positioning the electrical connector 10 on the printed circuit board 40 for soldering.

Figure 3:
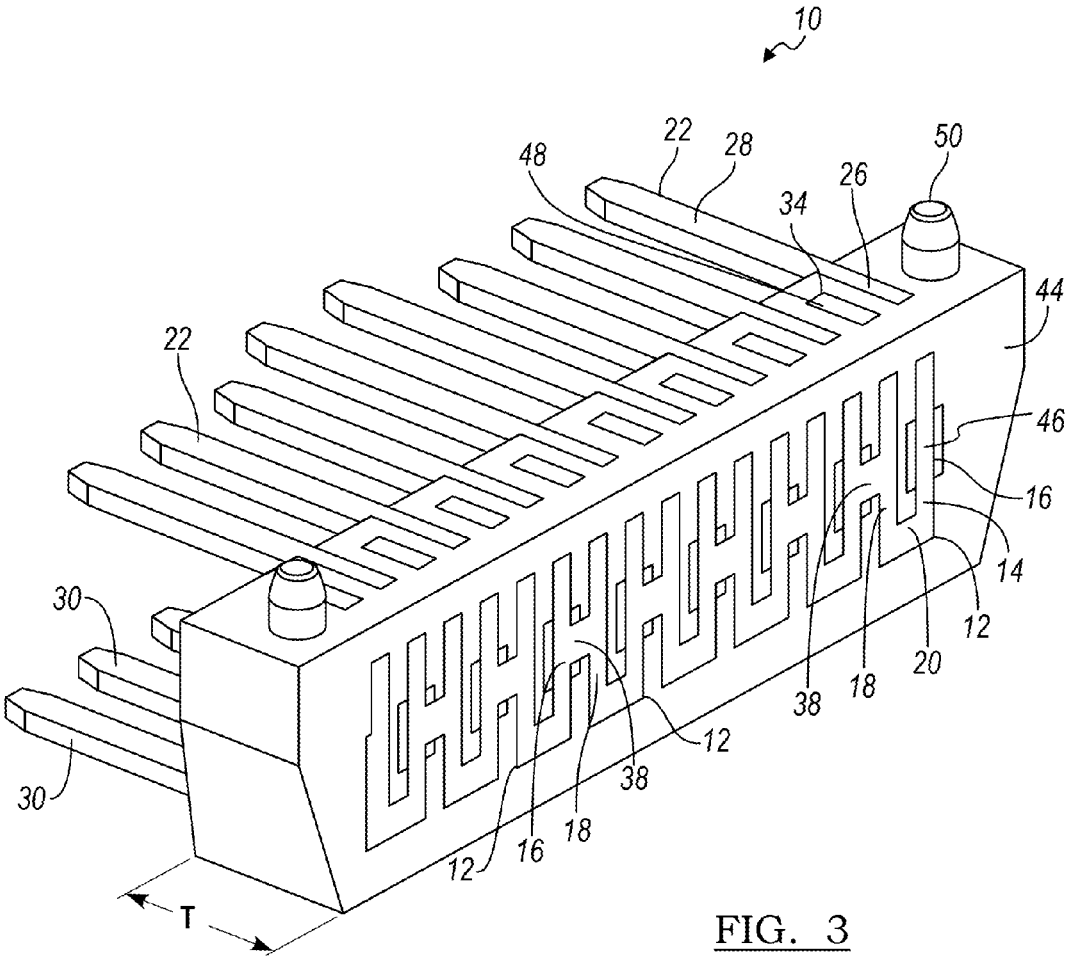
FIG. 3 is a perspective view of an electrical connector embedded in a plastic carrier in accordance with a form of the present disclosure.
Figure 4A:
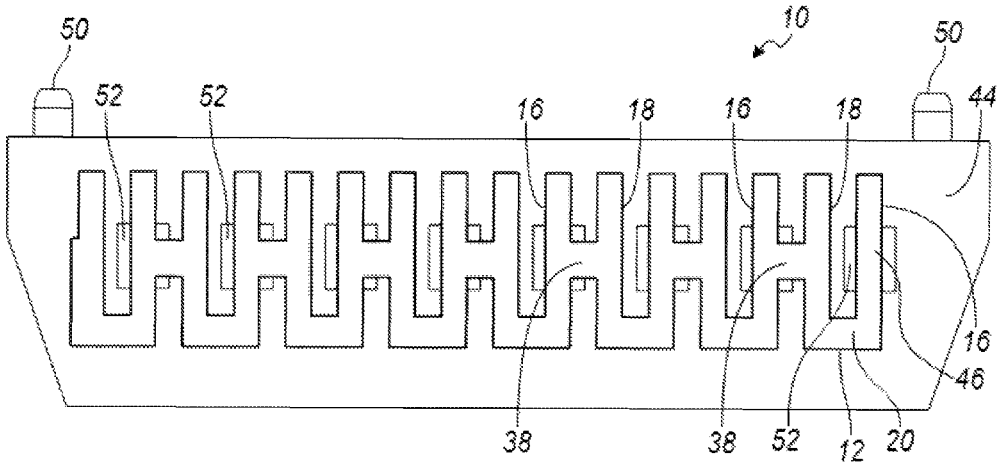
FIG. 4*a* is a top view of the electrical connector embedded in a plastic carrier of FIG. 3.
Figure 4B:
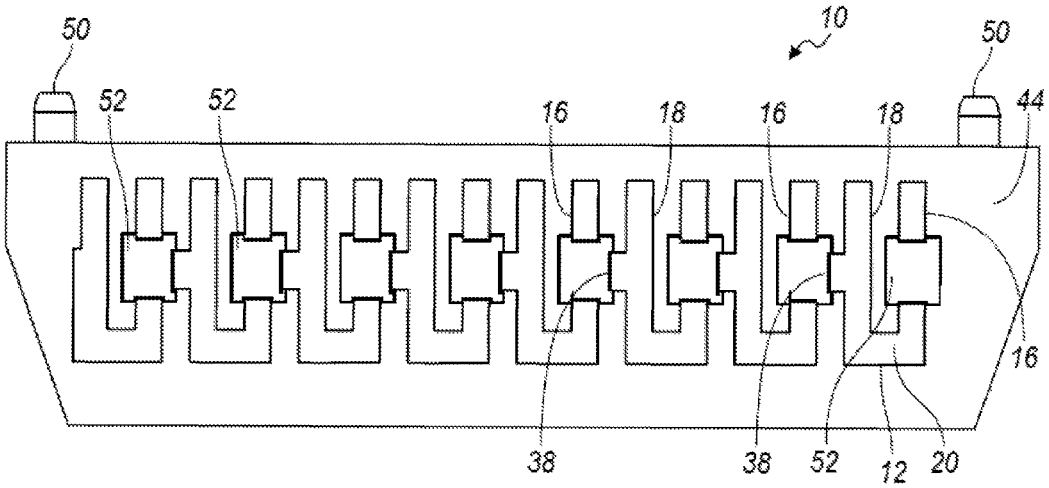
FIG. 4*b* is a top view of the electrical connector of FIG. 4*a* after portions of the electrical connector are removed.

As shown in FIGS. 3, 4*a*, and 4*b*, the electrical connector 10 may include a plastic carrier 44. In such an embodiment, the base 14 of each connector unit 12 is embedded in a plastic material that forms the plastic carrier 44. The plastic carrier embeds the base 14 of each connector unit 12 such that a first surface 46 of each connector unit base 14 remains uncovered by the plastic material of the plastic carrier. In other words, the surface 46 of the connector unit 12 that is opposite the pins 22, 30 remains exposed and uncovered by the plastic carrier 44. The plastic carrier 44 may further embed the soldering portion 26 and the soldering pad 34 of each connector unit 12 while leaving a soldering surface 48 of each soldering portion 28 and soldering pad 34 exposed. The plastic carrier 44 may include at least one fixturing tab 50 to assist with locating the electrical connector 10 relative to the printed circuit board 40. According to another form of the present disclosure, the plastic carrier 44 may define a plurality of apertures 52. The apertures 52 may extend through a thickness T of the plastic carrier 44. As best shown in FIG. 4*a*, each aperture 52 may be positioned such that the bridge 38 and the portion of the first arm 16 of each connector unit 12 that are configured to be cut out are positioned within the aperture 52 and are not embedded in the plastic carrier 44. Leaving bridges 38 and the portions of the first arms 16 that are to be cut out exposed rather than embedding these areas in the plastic carrier 44 allows for a clean cut or punch. FIG. 4*b* shows the electrical connector 10 embedded in the plastic carrier 44 after the portions of the bridges 38 and the first arms 16 initially positioned in the apertures 52 have been removed. The first surface 46 of the base 14 of each connector unit 12 may extend beyond the plastic carrier 44 such that the metal of the first surfaces 46 may rest directly on the machine used to cut or punch out the unembedded bridges 38 and the portions of the first arms 16 without interference from the plastic carrier.

The thickness T of the plastic carrier 44 may be such that the plastic carrier 44 extends from the first surface 46 of the base 14 to the area where the soldering portion 26 transitions to the blade portion 28 of each first pin 22. The plastic carrier 44 may be formed of a plastic material by an over molding or injection molding process. The plastic material of the plastic carrier 44 may be sufficiently durable to withstand being passed through a reflow oven during the process of soldering the electrical connector 10 to the printed circuit board 40.

Figure 5:
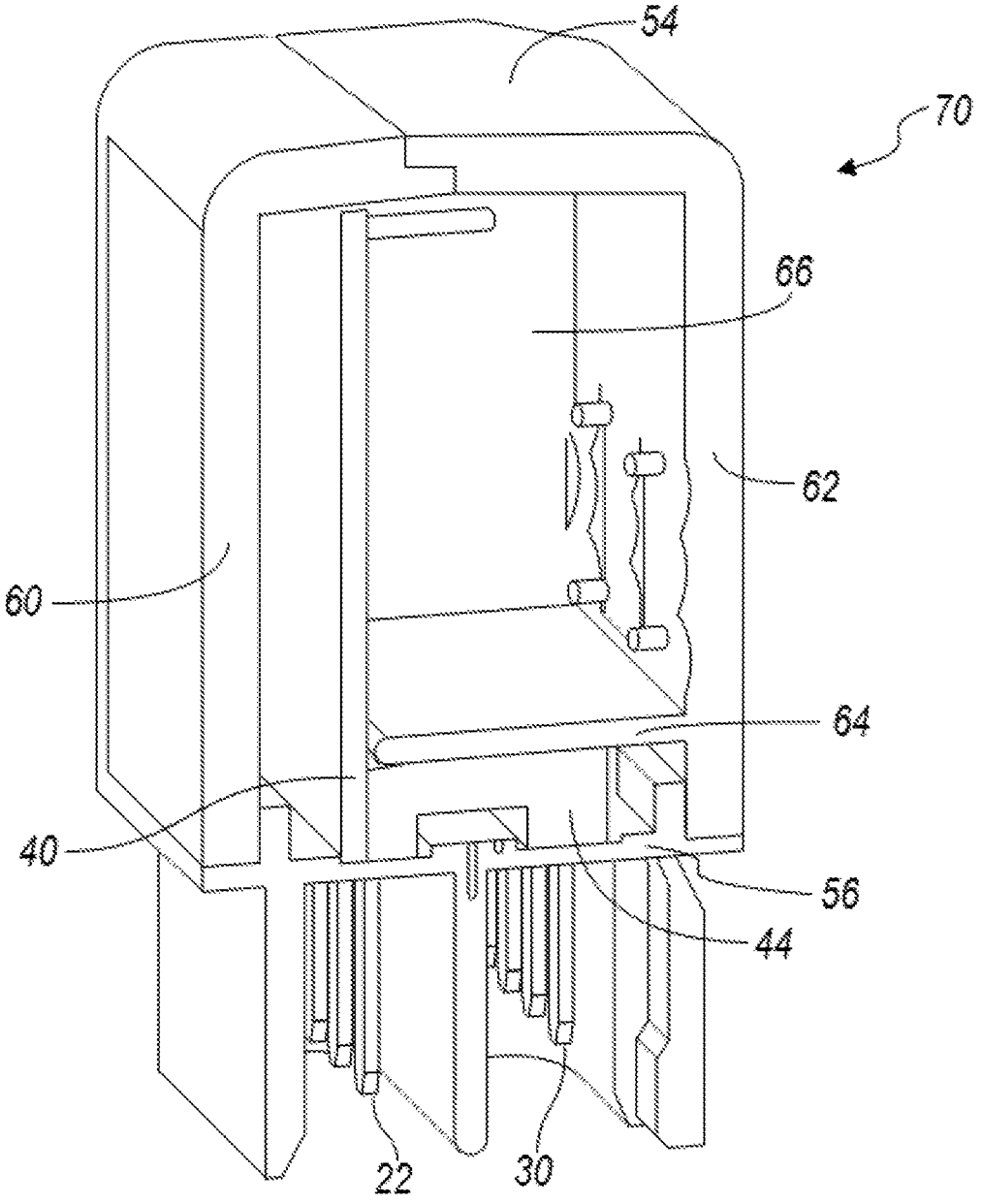
FIG. 5 is a perspective view of an electrical connector assembly in a housing in accordance with a form of the present disclosure.

According to FIG. 5, the electrical connector 10 may be installed in a housing 54. The housing 54 may include a wall 56 that defines a plurality of apertures 58 through which the pins 22, 30 of the electrical connector 10 may be inserted. The housing 54 may further include a first shell piece 60 and a second shell piece 62. The second shell piece may include a shelf 64 that protrudes from the second shell piece 62. The first shell piece 60 and second shell piece 62 may be joined together and joined with the wall 56. Joined together, the wall 56, first shell piece 60, and second shell piece 62 define a cavity 66 into which the shelf 64 protrudes. The cavity 66 may further house the printed circuit board 40. The shelf 64 may abut the first surface 46 of the base 14 of each connector unit 12 to lock the electrical connector 10 against the wall 56. The housing 54 may protect the printed circuit board 40 while the interaction of the wall 56 and the shelf 64 retain the electrical connector 10 and isolate the printed circuit board 40 from forces applied to the pins 22, 30 as the electrical connector 10 is attached and detached to external components.

The electrical connector may be connected to a vehicle via the vehicle's On-Board Diagnostic port or a similar connection port. Connecting the electrical connector to the vehicle via the On Board Diagnostic port powers the printed circuit board via the electrical connector and facilitates communications to and from the vehicle's computer system.

According to another form of the present disclosure, an electrical connector assembly 70 includes a single printed circuit board 40, a first row of electrically independent pins 22, and a second row of electrically independent pins 30. Each pin of the first row of pins 22 has a soldering portion 26 and a blade portion 28. Each soldering portion 26 may be soldered to the printed circuit board 40. Additionally, each pin of the second row of pins 30 has a soldering pad 34, a blade portion 31, and an arm portion 18. The arm portion 18 of each pin of the second row of pins 22 is integrally formed with both the soldering pad 34 and blade portion 31 of each second row pin 22 to connect the soldering pad 34 and blade portion 31 of each of the second row pins 22. Additionally, each soldering pad 34 may be soldered to the printed circuit board 40. The first row of pins 22 and the soldering pads 34 of the second row of pins 30 may be substantially coplanar. The soldering pads 34 of the pins of the second row of electrically independent pins 22 and the blade portion 31 of each pin of the second row of pins 22 may be substantially non-coplanar. In other words, the soldering pads 34 of the pins of the second row of pins 22 may be parallel to the blade portions 31 of the pins of the second row of pins 22 and spaced apart from the blade portions 31 of the pins of the second row of pins 22 by the arm portion 18 of each pin of the second row of pins 22.

The electrical connector assembly comprising the electrical connector 10 and the printed circuit board 40 may be installed in a housing 54. The housing 54 may include a wall 56 that defines a plurality of apertures 58 through which the pins 22, 30 of the electrical connector 10 may be inserted. The housing 54 may further include a first shell piece 60 and a second shell piece 62. The second shell piece may include a shelf 64 that protrudes from the second shell piece 62. The first shell piece 60 and second shell piece 62 may be joined together and joined with the wall 56. Joined together, the wall 56, first shell piece 60, and second shell piece 62 define a cavity 66 into which the shelf 64 protrudes. The cavity 66 may further house the printed circuit board 40. The shelf 64 may abut the first surface 46 of the base 14 of each connector unit 12 to lock the electrical connector 10 against the wall 56. The housing 54 may protect the printed circuit board 40 while the interaction of the wall 56 and the shelf 64 retain the electrical connector 10 and isolate the printed circuit board 40 from forces applied to the pins 22, 30 as the electrical connector 10 is attached and detached to external components.

Figure 6:
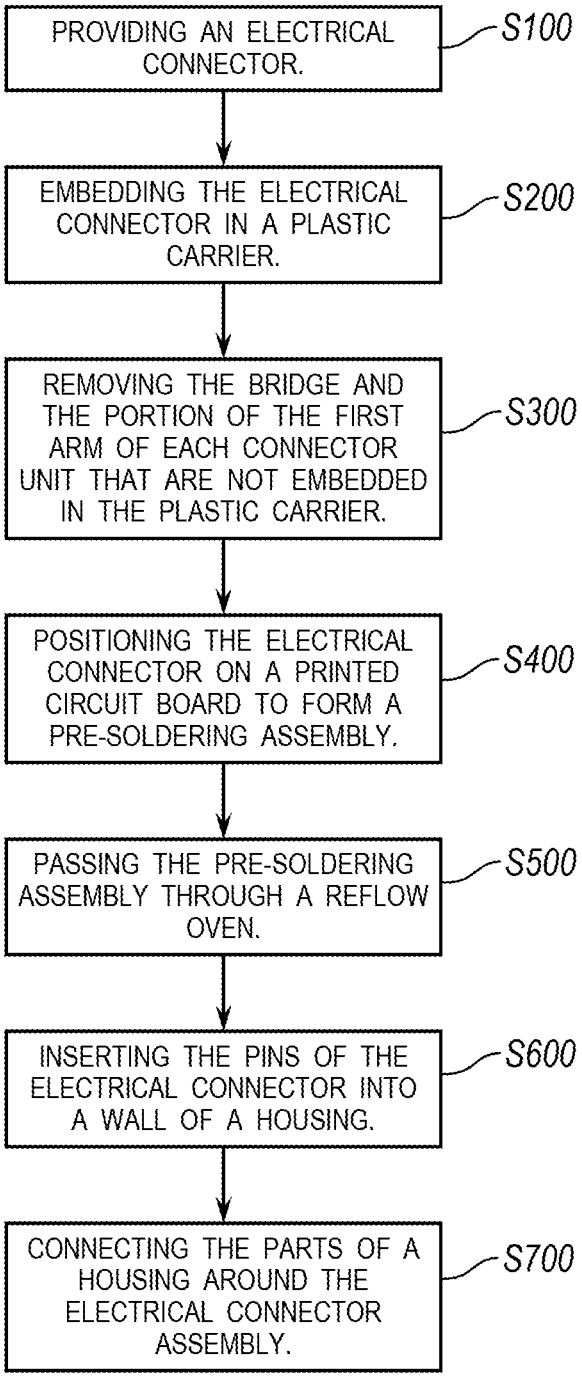
FIG. 6 shows the steps of a method for manufacturing an electrical connector assembly in accordance with a form of the present disclosure.

As shown in FIG. 6, a method for manufacturing an electrical connector assembly 70 includes providing an electrical connector S100 as described above. Specifically, the electrical connector 10 may include a plurality of connector units 12 each having a base 14 formed of a first arm 16 and a second arm 18. The first arm 16 and second arm 18 may be joined together by a cross member 20. Each connector unit 12 further having a first pin 22 integrally formed with and extending from a first end 24 of the first arm 16, a second pin 30 integrally formed with and extending from a second end 32 of the first arm 16, and a soldering pad 34 integrally formed with and extending from a first end 36 of the second arm 18. The first pin 22 having a soldering portion 26 and a blade portion 28. A bridge 38 may be integrally formed with and extend between the first arm 16 of one connector unit 12 and the second arm 18 of another connector unit 12 thereby linking the plurality of connector units 12 together to form an array of connector units 12, as described above.

The method further includes embedding S200 the base 14 of each of the connector units 12 in a plastic carrier 44 such that a first surface 46 of each connector unit base 14 remains uncovered by the plastic carrier 44. As described above, the plastic carrier 44 may define a plurality of apertures 52 that extend through a thickness T of the plastic carrier 44. Each aperture 52 is positioned such that the bridge 38 and a portion of the first arm 16 of each connector unit 12 are not embedded in the plastic carrier 44.

The method further includes removing S300 the bridge 38 and the portion of the first arm 16 of each connector unit 12 that are not embedded in the plastic carrier 44. The bridges 38 and the portions of the first arms 16 to which the bridges 38 are attached may be punched, cut, sheared, or stamped out in order to be removed. These areas not being embedded in the plastic carrier 44 allows for cleaner removal.

The method continues by positioning S400 the electrical connector 10 embedded in the plastic carrier 44 on a printed circuit board 40 such that the soldering portion 26 of each connector unit 12 and the soldering pad 34 of each connector unit 12 are in contact with the printed circuit board 40. This arrangement of the electrical connector 10 positioned relative to the printed circuit board 40 forms a pre-soldering assembly. Positioning S400 the electrical connector 10 embedded in the plastic carrier 44 on a printed circuit board 40 may include employing a fixturing tab 50 integrally formed with the plastic carrier 44 to locate the electrical connector 10 relative to the printed circuit board 40.

The method further includes passing S500 the pre-soldering assembly through a reflow oven to solder the soldering portions 26 and soldering pads 34 to the printed circuit board 40.

The method may further include inserting S600 the pins 22, 30 through a plurality of apertures 58 defined in a wall 56 of a housing 54 such that the plastic carrier 44 abuts the wall 56 of the housing 54 thereby retaining the pins 22, 30 relative to the wall 56. The method may also include connecting a first shell piece 60, a second shell piece 62, and the wall 56 such that the first shell piece 60, the second shell piece 62, and the wall 56 enclose the printed circuit board 40 and the plastic carrier 44 of the electrical connector 10 within the housing 54 and a shelf 64 protruding from the second shell piece 62 abuts the plastic carrier 44 thereby locking the plastic carrier 44 against the wall 56.

While the above description constitutes the preferred embodiments of the present disclosure, it will be appreciated that the disclosure is susceptible to modification, variation and change without departing from the proper scope and fair meaning of the accompanying claims.

What is claimed is:

1. An electrical connector comprising:

a plurality of connector units each having a base formed of a first arm and a second arm joined together by a cross member, each connector unit further having a first pin integrally formed with and extending from a first end of the first arm, a second pin integrally formed with and extending from a second end of the first arm, and a soldering pad integrally formed with and extending from a first end of the second arm, the first pin having a soldering portion and a blade portion; and a bridge integrally formed with and extending between the first arm of one connector unit and the second arm of another connector unit thereby linking the plurality of connector units together to form an array of connector units;

wherein the soldering portion and the soldering pad of each connector unit is configured to be soldered to a printed circuit board; and wherein the bridge and a portion of the first arm of each connector unit are configured to be cut out such that two rows of electrically independent pins are arranged on the printed circuit board.

2. The electrical connector of claim 1, further comprising a first fixturing tab integrally formed with and extending from the base of a first connector unit in the array of connector units and a second fixturing tab integrally formed with and extending from the base of a last connector unit in the array of connector units, wherein the first and second fixturing tabs are configured to locate the electrical connector relative to the printed circuit board.

3. The electrical connector of claim 1, wherein the base of each connector unit is embedded in a plastic carrier such that a first surface of each connector unit base remains uncovered by the plastic carrier.

4. The electrical connector of claim 3, wherein the plastic carrier comprises at least one fixturing tab configured to locate the electrical connector relative to the printed circuit board.

5. The electrical connector of claim 3, wherein the plastic carrier further embeds the soldering portion and the soldering tab of each connector unit while leaving a soldering surface of each soldering portion and soldering pad exposed.

6. The electrical connector of claim 3, wherein the plastic carrier defines a plurality of apertures extending through a thickness of the plastic carrier, wherein each aperture is positioned such that the bridge and the portion of the first arm of each connector unit that are configured to be cut out are not embedded in the plastic carrier.

7. The electrical connector of claim 1, wherein the pins are of unequal lengths.

8. The electrical connector of claim 1, wherein the pins have a constant cross-sectional area.

9. The electrical connector of claim 1, wherein the soldering portion of the first pin of each connector unit has a first cross-sectional area, and wherein the blade portion of the first pin of each connector unit has a second cross-sectional area greater than that of the first cross-sectional area.

10. The electrical connector of claim 9, wherein the cross-sectional area of the soldering portion of the first pin of each connector unit is substantially equal to a cross-sectional area of the soldering pad of each connector unit.

11. The electrical connector of claim 1, wherein the pins end in a tapered point.

12. The electrical connector of claim 1, wherein the electrical connector is formed of an electrically conductive material.

13. The electrical connector of claim 1, wherein the connector is installed in a housing having a wall, a first shell piece, and a second shell piece;

wherein the wall defines a plurality to apertures through which the pins are inserted;

wherein the first shell piece, the second shell piece, and the wall join together to define a cavity that houses the printed circuit board; and wherein a shelf that protrudes from the second shell piece abuts a first surface of the base of each connector unit and locks the electrical connector against the wall.

14. An electrical connector assembly comprising:

a single printed circuit board;

a first row of electrically independent pins, wherein each pin has a soldering portion soldered to the printed circuit board and a first blade portion; and a second row of electrically independent pins, wherein each pin has a soldering pad soldered to the printed circuit board, a second blade portion, and an arm portion integrally formed with and connecting the soldering pad and the second blade portion of each pin, a housing having a wall, a first shell piece, and a second shell piece; wherein the wall defines a plurality to apertures through which the pins are inserted; wherein the first shell piece, the second shell piece, and the wall join together to define a cavity that houses the printed circuit board; and wherein a shelf that protrudes from the second shell piece locks the pins against the wall.

15. The electrical connector assembly of claim 14, wherein the first row of pins and the soldering pads of the second row of pins are substantially coplanar.

16. The electrical connector assembly of claim 15, wherein the soldering pads of the pins of the second row of electrically independent pins and the second blade portion of each pin of the second row of pins are non-coplanar.

* * * * *